US008242914B2

(12) United States Patent
Matityaho et al.

(10) Patent No.: US 8,242,914 B2
(45) Date of Patent: Aug. 14, 2012

(54) SYSTEM AND CASE FOR TRACKING ARTICLES

(75) Inventors: Shlomo Matityaho, Tel Mond (IL); Ely Levine, Rehovot (IL)

(73) Assignee: Logitag Systems Ltd., Netanya (IL)

( * ) Notice: Subject to any disclaimer, the term of this patent is extended or adjusted under 35 U.S.C. 154(b) by 779 days.

(21) Appl. No.: 12/295,546

(22) PCT Filed: Dec. 27, 2006

(86) PCT No.: PCT/IL2006/001495

§ 371 (c)(1),
(2), (4) Date: Mar. 27, 2009

(87) PCT Pub. No.: WO2007/113786

PCT Pub. Date: Oct. 11, 2007

(65) Prior Publication Data

US 2011/0199212 A1 Aug. 18, 2011

(30) Foreign Application Priority Data

Mar. 30, 2006 (IL) ..... 174671

(51) Int. Cl.
*G08B 13/14* (2006.01)

(52) U.S. Cl. ..... 340/572.7; 340/572.1; 340/568.1; 340/693.5; 340/545.6

(58) Field of Classification Search .... 340/572.1–572.9, 340/545.6, 568.1, 5.92, 540, 693.5; 343/893, 343/894, 866, 867; 705/22, 23, 24, 28
See application file for complete search history.

(56) References Cited

U.S. PATENT DOCUMENTS

| | | | | |
|---|---|---|---|---|
| 5,798,694 | A * | 8/1998 | Reber et al. | 340/540 |
| 6,407,665 | B2 | 6/2002 | Maloney | |
| 6,650,225 | B2 | 11/2003 | Bastian | |
| 6,650,240 | B2 | 11/2003 | Lee | |
| 6,677,857 | B2 * | 1/2004 | Bara et al. | 340/572.1 |
| 6,703,935 | B1 * | 3/2004 | Chung et al. | 340/572.7 |
| 6,707,381 | B1 | 3/2004 | Maloney | |
| 6,843,415 | B2 | 1/2005 | Vogler | |
| 6,847,892 | B2 | 1/2005 | Zhou et al. | |
| 6,870,464 | B2 | 3/2005 | Okamura | |
| 6,883,710 | B2 | 4/2005 | Chung | |
| 6,927,692 | B1 | 8/2005 | Petrinovic | |
| 6,935,560 | B2 | 8/2005 | Andreasson | |
| 6,977,612 | B1 | 12/2005 | Bennett | |
| 7,406,439 | B2 * | 7/2008 | Bodin et al. | 705/22 |
| 2003/0102970 | A1 | 6/2003 | Creel | |
| 2005/0110640 | A1 | 5/2005 | Chung | |
| 2005/0150952 | A1 | 7/2005 | Chung | |
| 2006/0017570 | A1 | 1/2006 | Moskowitz | |

* cited by examiner

*Primary Examiner* — Anh V La
(74) *Attorney, Agent, or Firm* — Browdy and Neimark, PLLC

(57) ABSTRACT

The present invention provides an article tracking and control system that records articles when they are entered into or removed from a case. Each article is tagged with an RFID tag and is identified individually by the system. The system comprises: wireless identification device attached to each article; a case for containing the tagged articles; an antenna mounted close to the cover of the case so that the antenna is able to read the tagged articles entering or being removed from the case, while tagged articles inside the case are not detected by the antenna; processing means for tracking each entry and removal of a tagged article into or out of the case; and means for visualizing reports and/or alerts regarding the status of tagged articles inside the case.

20 Claims, 4 Drawing Sheets

SYSTEM AND CASE FOR TRACKING ARTICLES

FIELD OF THE INVENTION

The present invention relates to a system for tracking the presence or absence of articles in an intelligent toolbox.

BACKGROUND OF THE INVENTION

Many professionals rely on tools of their trade in order to carry out their professional tasks, ranging from a technician going to repair a machine to a surgeon entering into a surgery room. These professionals need to confirm that all their required tools are inside their toolbox before they start to work and that when their work is finished, all the tools are put back into the toolbox and no tool is forgotten behind.

In recent years, many systems and methodologies have been developed and implemented to track and control inventory in places such as storage facilities, retail stores, storage cabinets, etc. A common solution is an implementation of a sign-off sheet where the user marks the items that are checked out or returned. Naturally, such manual systems are not very reliable due to human errors and thus cannot be used in cases where high-reliability is essential.

In more recent years, automated, computer-based systems have been introduced to control and track items and inventory. Attaching individual identification means to each item has enabled better tracking of the item at certain points. Barcodes are a very popular mean to identify an item, and scanning the barcode, for example at a retail store cash register, enables to identify the item. Barcodes are very popular due to their availability, low cost and simple implementation. As widespread as they are, barcodes have limitations. They require line of sight access to an optical scanner. Reading a barcode often requires human interaction to position the scanner or the coded item. A barcoded item can only convey the original information carried in the code, and cannot be updated in any way. A barcode's size effectively limits the amount of data that can be stored on it.

Radio Frequency Identification tags (RFID) represent a significant improvement compared to barcode technology. Rather than using visible light as a communication medium, RFID technology uses radio waves. Rather than using an optical scanner, the RFID application uses a 2-way radio, known as a reader. Rather than having data encoded on a visual barcode, an item tracked with RFID technology has affixed to it a small computer chip with the capacity to contain far more data than a barcode. In addition, the chip is equipped with an antenna which allows it to both send and receive data.

The chip, antenna and casing together are known as an RFID tag. When a tagged item is close enough to an RFID reader, the reader electronically induces the tag to send the data on its chip to the reader using its antenna. Since radio waves pass through most materials, no line of sight is necessary.

The Electronic Product Code (EPC) is used for identifying the object to which the tag is attached. The EPC has a 96-bit capacity and is made up of a header that gives information on the length of the EPC number, the type and version of code. The header requires 8 bits of memory; the EPC manager requires 28 bits and identifies the manufacturing company; the object class takes 24 bits and classifies the item; and the serial number requires 36 bits and identifies an item within a class. The EPC resides in the chip, the chip is attached to a coiled antenna and this assembly is housed in a packaging best suited to be affixed to the object that has to be monitored.

Tags are classified as active, passive, and semi-passive. Electronic Article Surveillance (EAS) tags used widely in the retail industry are the best examples of passive tags. Tags are also classified in terms of their memory as read only, read/write, and combination tags. Passive tags do not have their own source of energy and use the method known as "energy harvesting" to absorb energy from a reader and use it to transmit the data back to the reader at a different frequency.

Active tags have their own power source but can be read only when they come in the read range of the reader. An internal power source means that active tags have a greater range than passive tags. They can be read from a distance of around 30 yards. However, the inclusion of a battery has increased the weight and cost of active tags and has reduced its life to equal the span of the battery, which currently is around five years.

Semi-passive tags are equipped with a sensor that enables the monitoring of temperature, movement, etc. They are used in situations like cold chains where it is important to track the movement as well as the condition of an item.

The reader has three main components; an antenna, a receiver, and a decoder. The complexity of the readers is a function of the type of tags they are meant to support. The read range is a function of the size and efficiency of the antenna and the transmitter power. The area covered and range of operation increases with the number of antennas. Upon receiving information from a tag in its read range, the reader processes the information in its decoding software and then transmits it to the information management system that it is connected to.

The rate at which data is transferred is directly proportional to the frequency of the radio waves. The variations in the regulations that govern the frequency ranges used in different countries are an impediment to the growth of RFID. The read range of the tag is influenced by the frequency of the radio waves, the power in the tag, the power in the reader, working environment, and antenna size.

Factors that affect the read rates include the type of tags and their placement on the pallet, case, or item; the orientation of the antenna; reader settings, etc. Pilots conducted in controlled conditions are very often inaccurate indicators of tag-reader performance. Sources of interference in actual work conditions include cell phones, walkie-talkies, metals, liquids, etc.

There is a need in the art to provide a reliable, easy-to-use and cost-effective system that can assure a professional that all his required tools are in the required case both before starting to work and once work is finished.

SUMMARY OF THE INVENTION

The present invention relates to an article tracking and control system comprising:

(i) wireless identification means for attaching to articles to be tracked;

(ii) a case for containing said articles to be tracked wherein said articles are tagged with said identification means;

(iii) an antenna mounted close to the cover of said case so that said antenna is able to read said tagged articles of (ii) entering or being removed from said case, while tagged articles inside the case are not detected by said antenna;

(iv) processing means for tracking each entry and removal of said tagged articles into or out of said case; and (v) means for visualizing reports and/or alerts regarding the status of said tagged articles inside said case.

The system records the tagged articles when they are entered into or removed from the case. The system disregards articles already inside the case. Preferably, the articles are tagged with RFID tags, though other technologies can also be used to track articles.

The implementation of the antenna is critical since articles already inside the case should be ignored. In a preferred embodiment of the present invention, a loop antenna is mounted into the perimeter of the case. One or more metal patches located close to the antenna confine the magnetic field to area close to the loop antenna thus preventing the magnetic field to reach into articles already inside the case.

Alternatively, the antenna can be built as a flat, thin strip. The thin strip antenna can be integrated into the case or come already built-in with the case. The thin strip is able to conform to the external layout of the case so that it covers the entire perimeter of the case without protruding from the case. Having the antenna integrated into the case and not presenting any bumps or external shapes to the case is advantageous since the antenna is less likely to get harmed from accidental contact with an object, and the look of the case is not changed.

The system is initially configured by the user to contain a quantity of articles. Each individual article is registered with the system. In operation, the system tracks and records every entry and exit of an article. Upon closure of the case's cover, or upon an explicit demand from the user, the system compares the list of articles currently inside the case with the full list of articles that should be inside the case, and alerts the user if any registered article is missing and is not inside the case.

Alerts can be provided locally, preferably with a display screen attached to the case, with an optional sound alert. Alerts may also be provided to a remote system when the case is equipped with communication means such as an Internet connection, a telephone, a mobile phone connection, etc.

The system also provides reports regarding the status of articles in a given time, or time period. For example, a user can learn which articles were outside the case at a given tune, or in a given time period. The system can also provide a report about one or more specific articles, and track they entry and removal history.

DETAILED DESCRIPTION OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention relates to an intelligent toolbox or case containing tools or articles and means for tracking said tools or articles. The intelligent toolbox provides a much-needed solution for a wide range of applications in which the user relies on his professional tools and thus needs the make sure all the tools are in the toolbox or case before starting to work, and after finishing the work. The need to control and monitor professional tools of the trade is felt strongly with medical staff, repair technicians and engineers, aerospace workers or military personnel.

The present invention provides an article tracking and control system comprising:

(i) wireless identification means for attaching to articles to be tracked;

(ii) a case for containing said articles to be tracked wherein said articles are tagged with said identification means;

(iii) an antenna mounted close to the cover of said case so that said antenna is able to read said tagged articles of (ii) entering or being removed from said case, while tagged articles inside the case are not detected by said antenna;

(iv) processing means for tracking each entry and removal of said tagged articles into or out of said case; and (v) means for visualizing reports and/or alerts regarding the status of said tagged articles inside said case.

The system records articles when they are entered into or removed from the case. The system disregards articles already inside the case. Each article needs to be identified individually by the system. Preferably, the articles are tagged with RFID tags, though other technologies can also be used to track articles, and thus should be considered within the scope of the invention. The term tagged article as used herein means every identification mean that is attached to an article to be tracked. All articles reside within a special-purpose case such as a professional toolbox, and are taken out of the case for a limited time-period, typically to perform a professional task. The system then verifies that all tools are back into the case when the task is completed. Alternatively, the system may also confirm the presence of all registered articles inside the case before starting the professional task, or at any given point when the user wishes to control the case.

Figure 1:
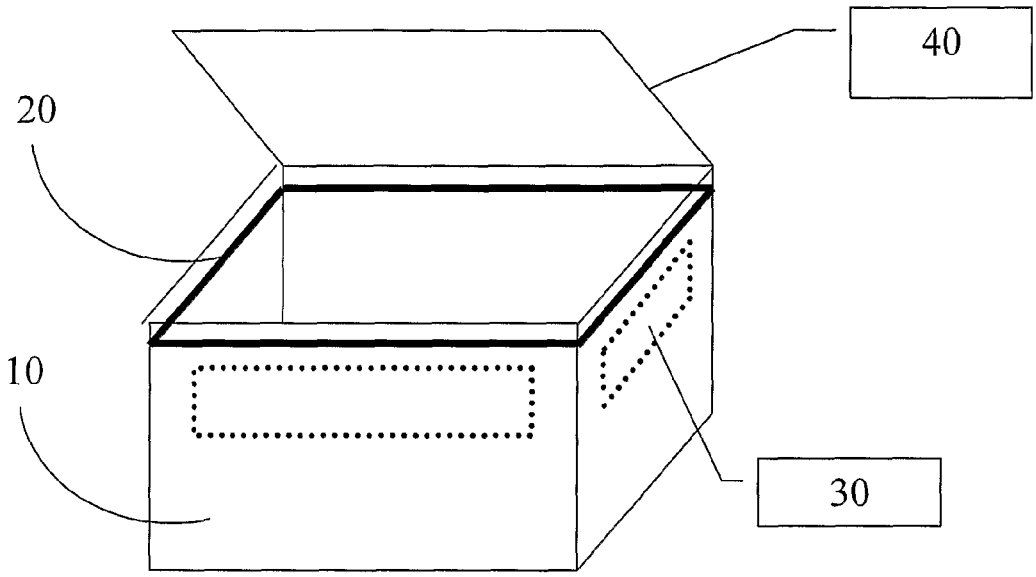
FIG. 1 shows a case of the invention with a loop antenna and metal patches.

FIG. 1 illustrates a case 10 wherein movement of articles in and out of the case 10 is detected by a loop antenna 20, which is mounted at the perimeter of the case 10. The loop antenna's 20 shape is conformed to the specific dimensions and shape of the case 10. Special metal patches 30 confine the magnetic field to the close vicinity of the loop antenna 20 and prevent the penetration of the magnetic field into the depth of the case 10. The system controls if all the articles are back inside the case 10 whenever the cover 40 is closed or when the user specifically asks for it.

Figure 2:
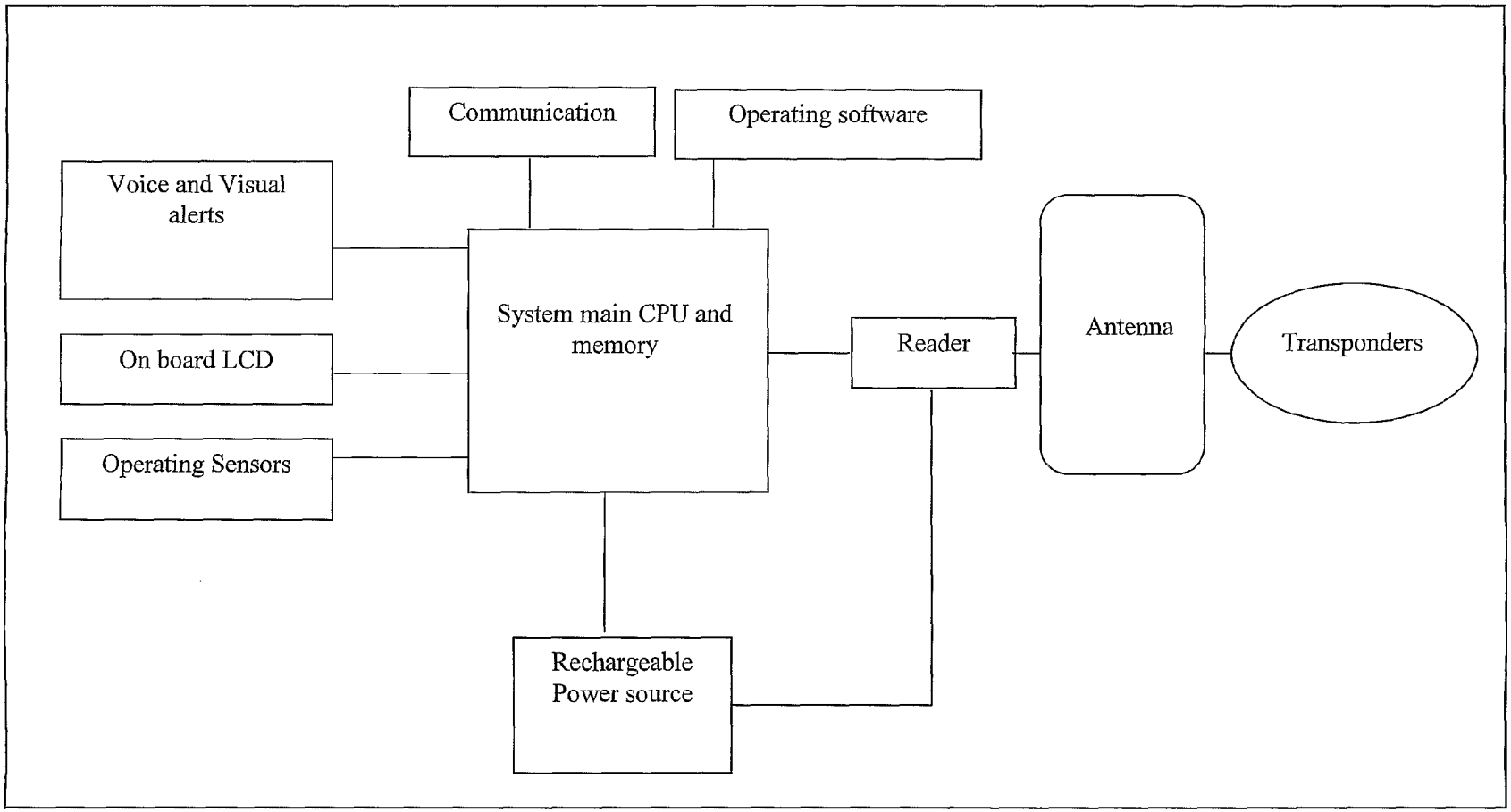
FIG. 2 is a diagram of the system's main building blocks.

FIG. 2 is a diagram of the system's main building blocks:

System Main CPU—The Central Processing Unit (CPU) controls the case 10 operation and logic. The CPU should have a low electric consumption providing sufficient processing power. The CPU is coupled with non-volatile memory such as Erasable Electronic Programmable Read Only Memory (EEPROM).

The Reader—The reader is responsible for the communication with the transponder via the antenna. Balancing the reader's power consumption so that it is low on one hand but with a good reading range on the other hand is one of the main challenges of the system. The reader supports Low-Frequency (LF) and High-Frequency (HF) frequencies.

The Power source—The power source is preferably rechargeable and controlled by a power consumption algorithm, which puts the system in a sleep mode, with low power consumption, during idle periods in order to reduce the power consumption. The system will enter sleep mode in two cases: in the first one, when the box cover is closed; and in the second one, when the cover is open and no tagged article is either entered or removed from the case for a period of time greater than a defined time value.

Operating sensor—The sensor indicates to the system whether the cover is open or closed.

On board LCD and keypad—This unit provides the user with the ability to communicate with the system. Actions that the user can request or view include but are not limited to: register a new article in the system; withdraw a registered article from the system; view the existing articles in the case 10; view the articles currently outside the case 10; view which articles were in the case 10 at a given time point; and view a report on times of entry and exit from the case 10 of one or more articles in a given time period.

Input from the user can be received by a variety of devices including but not limited to: a keyboard, a keypad, a touch screen, a voice-recognition system, pre-labeled buttons, dynamic buttons positioned adjacent to the display, a mouse, a joystick, or any other selection device.

For example, the system can come with a full keyboard, or alternatively provide some information on the screen and let the user select an option from the screen, or type using a virtual on-screen keyboard. Examples of selection devices where the user can select a given response include a mouse, a joystick or a touchscreen. Other methods can also be used to receive input from the user including: a voice recognition system; using pre-labeled buttons such as "YES", "NO", "NEXT" etc; and using dynamic buttons adjacent to the screen wherein the label of the button is dynamically displayed on the screen according to the context, similar to the way the menu choices of a mobile phone or an Automatic Teller Machine (ATM) behave.

Voice and Visual alerts—This unit provides voice and visual alerts in case the case 10 is closed and an article is missing from the case 10. The system can be configured to provide alerts in predefined situations for example when the cover 40 is closed, but not all registered articles are back into the case 10. Another situation when an alert is useful is when cover 40 is open for a period of time, extending beyond a predefined value. Alerts may be provided visually by a message on the display screen. Alerts may also be provided via a sound, such as a beep or a voice message, for example "there are 2 articles missing from the toolbox". Another implementation of alerts can be via red and green lights, wherein when the cover 40 is closed, a green light signals that all registered articles are inside, while a red light would signal that at least one registered article is missing. Preferably, the system provides an appropriate message regarding which article is missing.

Communication unit—The communication unit enables the case 10 to communicate with a remote system. The communication unit transfers information regarding article movements as well as inventory to a management system. The communication unit includes communication means such as cellular communication, Short Message Service (SMS), Enhanced Message Service (EMS), Multimedia Message Service (MMS), e-mail, Instant Message (IM), Internet connection, local area network, wide area network, connecting said case as a peripheral device to a computer system, an RS232 or 484 port, TCP/IP, WiFi, GPRS, CDPD, Bluetooth, or any other wireless network.

Antenna—The antenna working together with the high performance reader is able to detect the transponder as it is going trough a small reading range, in very high speed. The main challenge of the antenna is to detect the transponder as it is going trough a small though high-power reading range.

Figure 3:
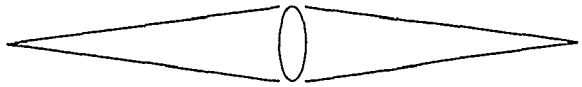
FIG. 3 represents the antenna's reading range.

FIG. 3 represents the antenna's reading range, which covers an as flat as possible surface near the entrance area of the case 10, without covering areas outside or inside the case 10.

The implementation of the antenna is critical since articles already inside the case 10 should be ignored. In a preferred embodiment of the present invention, a loop antenna 20 is mounted into the perimeter of the case 10. One or more metal patches 30 located close to the antenna confine the magnetic field to area close to the loop antenna 20 thus preventing the magnetic field to reach into articles already inside the case 10.

The loop antenna 20 has a typical inductance L that is a function of the size of the antenna and the number of turns N around the case 10. A practical approximation for the calculation of L is given as follows: assuming a rectangular loop with area A, made of N turns around the case 10. The length of the loop is l1, the width is l2 and the diagonal is lc. The diameter of the wire is 2a. Under these definitions, the inductance is given by:

$$L(\text{nH})=4N^2\{l1 \ln [2A/a(l1+lc)]+l2 \ln [2A/a(l2+lc)]\}$$

ln denotes the natural logarithm (with a basis of e)

a, l1, l2 and lc are given in centimeters

A is given in centimeters squared

Small variations in the loop shape do not change the inductance in a meaningful way. Moreover, such small variations, which are caused by any specific structure of the toolbox, are compensated by a matching circuit.

Following is a numerical example given for a standard industrial toolbox:

N=4

L1=53 cm

L2=30 cn

Lc=61 cm

A=1590 $cm^2$

2a=0.6 cm

L=24,500 nH=24.5 mH

The loop antenna 20 works at the resonant frequency of 125 kHz or 134 kHz which matches the resonant frequency of the RFID reader. In order to create the appropriate resonant frequency, the antenna should be connected to a matching circuit composed of equivalent Capacitor (with capacitance C) and equivalent Resistor (with resistance R). The resonant frequency f is then given by:

$$f=\tfrac{1}{2}\pi\sqrt{LC}=125 \text{ or } 134 \text{ kHz}$$

L is the Inductance of the loop antenna 20 (Henry)

C is the equivalent Capacitance of the matching circuit (Farad)

The Quality Factor of the resonance is defined by the ratio between the center frequency and the bandwidth and is also defined by:

$$Q=R/2pfL$$

L is the Inductance of the loop antenna 20 (Henry)

R is the equivalent Resistance of the matching circuit (ohms)

In order to avoid sensitivity of the antenna to external effects of the case 10 structure and the case's 10 contents, it is preferred to have Q between the values of 10 to 20.

Numerical Example (for a standard industrial tool box):

L=24.5 mH

C=57.6 nF

R=390 W f=134 kHz

Q=20

In order to prevent RFID readings of tools that reside inside the toolbox the magnetic field of the loop antenna is confined to the vicinity of the cover of the toolbox. Special metal patches attached to the walls that deflect the magnetic field profile towards the toolbox upper cover achieve this confinement.

Figure 4:
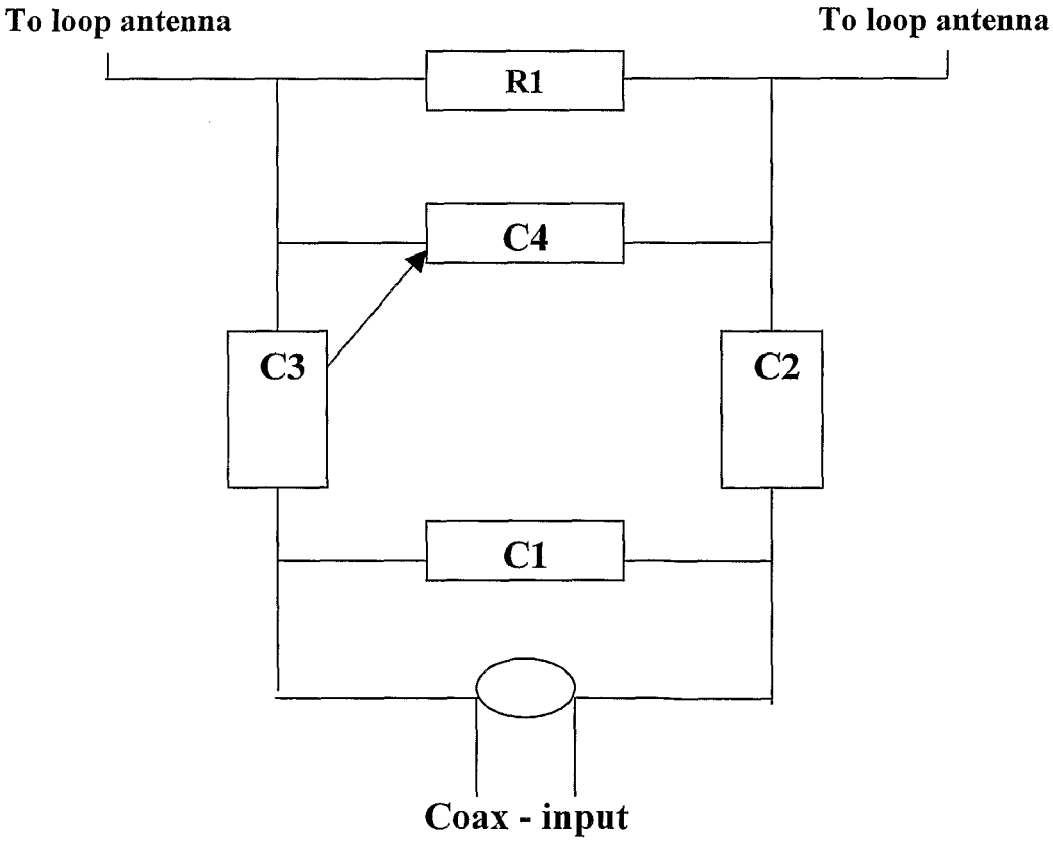
FIG. 4 is a diagram of an electrical circuit built to create a resonant frequency of the loop antenna.

The matching circuit can be realized in a variety of ways. FIG. 4 shows one practical way using one resistor R1 (in parallel to the loop) and four Capacitors, a main Capacitor C1, a variable Capacitor C4 which tunes the exact resonant frequency and two other Capacitors C2 and C3 used to ensure appropriate matching to the input cable in a balanced mode. As noticed before, any small variations in L—caused by small details of any box structure or box contents or environmental effects—are compensated by the variable Capacitor C4.

The reader and the power source are designed to provide high performance RFID reading with a low power consumption.

Figure 5:
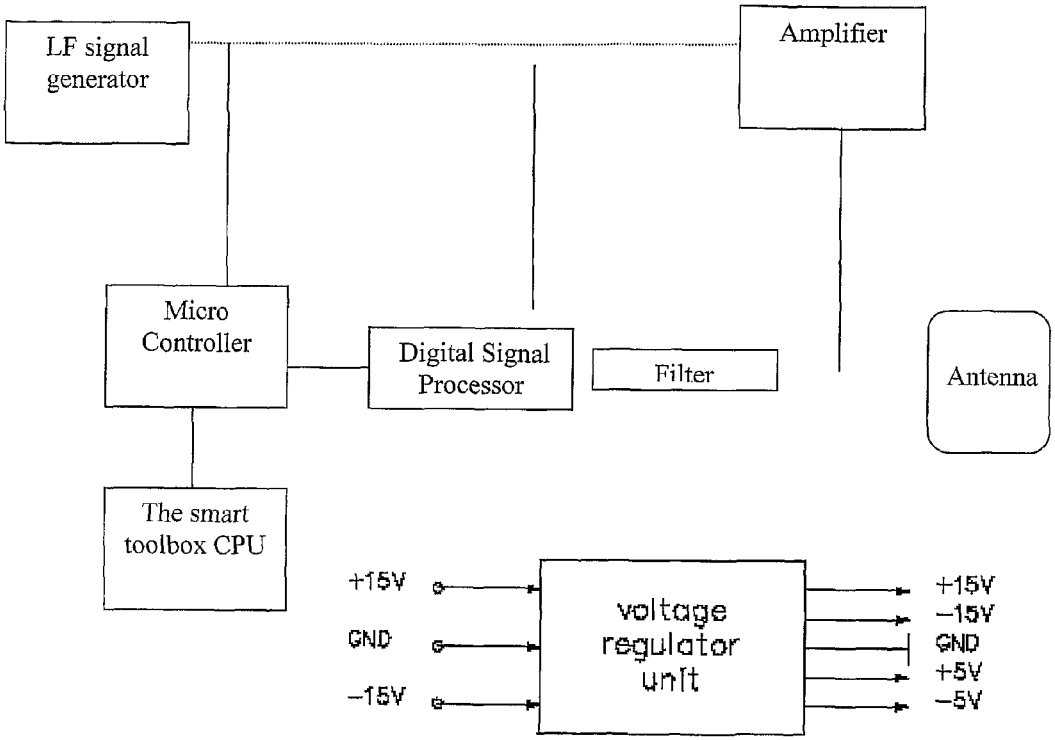
FIG. 5 is a block diagram of the system's reader.

FIG. 5 is a block diagram of the system's reader.

The micro controller has three main functions:

(1) to processes the protocol for the communication between the transponders and the read/write unit;

(2) a control function, the micro controller activates and deactivates the transmitter and switches the receiver between the modes for the different transponders reception; and (3) controlling the standby mode of the amplifier, detection of detuned or broken antennas (antenna malfunction) and controlling of the input and output for general purpose.

The signal is transferred to the Digital Signal Processor (DSP), which contains a receiver and transmitter. The signal arrives to the DSP's receiver after filtering and demodulation of the amplitude-modulated signal received by the antenna from the transponder. The DSP processes the signal further before sending it, via the DSP's transmitter, to the microcontroller.

The receiving part of the reader module includes band pass filters, which attenuate disturbances. For disturber frequencies near the 125 kHz (e.g. harmonics of the line frequency of PC monitors, long wave transmitters) a Fourier transformation is used to recognize harmonic disturbers and to eliminate their influence. The DSP is also responsible for separating the responses of different transponders during anti collision cycles.

New articles can be added to the system for tracking and existing articles can be withdrawn from the system through a process of article registration.

Adding a new article—an RFID tag is attached to the new article to be tracked; the article registration function is activated by the user, for example by selecting it from a menu list; the new article is introduced into the case 10; the system confirms identification of the new article, for example via a text message, an audio signal or a visual signal; and the user enters the name of the new article. A new article can be of a type already existing in the case 10, for example a second screwdriver, or a brand new article not existing and registered in the system. The system can be configured with various levels of flexibility in registering new articles according to the commercial and professional implementations. One system can be configured with a predetermined list of articles, wherein either no new article can be added, or the user may add only an additional article of a type from the predetermined list. In a more flexible implementation, the user may add to the system any new article and freely define the names and types of new articles.

Existing articles tracked by the system may be withdrawn from the system. Once declared as withdrawn, the system no longer tracks these articles.

In one embodiment of the present invention, the tagged articles to be tracked are metallic tools or tools made essentially out of metal.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. An article tracking and control system comprising:

(i) wireless identification means for attaching to articles to be tracked;

(ii) a case for containing said articles to be tracked wherein said articles are tagged with said identification means;

(iii) an antenna mounted close to the cover of said case so that said antenna is able to read said tagged articles of (ii) entering or being removed from said case, while tagged articles inside the case are not detected by said antenna;

(iv) processing means for tracking each entry and removal of said tagged articles into or out of said case; and (v) means for visualizing reports and/or alerts regarding the status of said tagged articles inside said case.

2. The article tracking and control system of claim 1, wherein at least one of said tagged articles to be tracked is a metallic object.

3. The article tracking and control system of claim 1, further comprising a communications unit means, using at least one of the following technologies: cellular communication, Short Message Service (SMS), Enhanced Message Service (EMS), Multimedia Message Service (MMS), e-mail, Instant Message (IM), Internet connection, local area network, wide area network, connecting said case as a peripheral device to a computer system, an RS232 or 484 port, TCP/IP, WiFi, GPRS, CDPD, Bluetooth, or any other wireless network.

4. The article tracking and control system of claim 1, further comprising means for receiving user input regarding reports, alerts or registration of new articles in said case and/or further providing alerts via sound, voice or both.

5. The article tracking and control system of claim 1, wherein said antenna is a loop antenna mounted on the perimeter of said case or a flat, thin strip.

6. The article tracking and control system of claim 5, wherein said thin strip is integrated in said case and/or said antenna conforms to the external layout of said case.

7. The article tracking and control system of claim 1, wherein the presence of each registered article to be tracked is verified upon closure of said case.

8. The article tracking and control system of claim 5, further comprising at least one metal patch located close to said loop antenna, said metal patch confining the magnetic field to the area close to the loop antenna thus preventing the magnetic field to reach into tagged articles already inside said case.

9. The article tracking and control system of claim 1, wherein said tagged articles are tools used by medical staff, repair technicians and engineers or military personnel.

10. The article tracking and control system of claim 1, wherein said reports include articles present in the case at a given time-point, articles absent from the case at a given time-point, or usage frequency of one or more articles in a given time-period.

11. A case for tracking and control articles, said case comprising:

(i) articles tagged with wireless identification means;

(ii) an antenna mounted into the perimeter of said case so that said antenna is able to read said tagged articles of (i) entering or being removed from said case, while tagged articles inside the case are not detected by said antenna;

(iii) processing means for tracking each entry and removal of said tagged articles into or out of said case; and (iv) means for visualizing reports and/or alerts regarding the status of said tagged articles inside said case.

12. The case of claim 11, wherein at least one of said tagged articles to be tracked is a metallic object.

13. The case of claim 11, further comprising a communications means unit, wherein said communications unit communicates using at least one of the following technologies: cellular communication, Short Message Service (SMS), Enhanced Message Service (EMS), Multimedia Message Service (MMS), e-mail, Instant Message (IM), Internet connection, local area network, wide area network, connecting said case as a peripheral device to a computer system, an RS232 or 484 port, TCP/IP, WiFi, GPRS, CDPD, Bluetooth, or any other wireless network.

14. The case of claim 11, further providing alerts via sound, voice or both and/or further comprising means for receiving user input regarding reports, alerts or registration of new articles in said case, wherein said means for receiving user input comprise: a keyboard, a keypad, a touch screen, a voice-recognition system, pre-labeled buttons, dynamic buttons positioned adjacent to the display, a mouse, a joystick, or any other selection device.

15. The case of claim 11, further wherein said antenna is a loop antenna mounted on the perimeter of said case or a flat, thin strip.

16. The case of claim 15, wherein said thin strip is integrated in said case and/or said antenna conforms to the external layout of said case.

17. The case of claim 11, wherein the presence of each registered article to be tracked is verified upon closure of said case.

18. The case of claim 15, further comprising at least one metal patch located close to said loop antenna, said metal patch confining the magnetic field to the area close to the loop antenna thus preventing the magnetic field to reach into articles already inside said case.

19. The case of claim 11, wherein said articles are tools used by medical staff, repair technicians and engineers or military personnel.

20. The case of claim 11, wherein said reports include articles present in the case at a given time-point, articles absent from the case at a given time-point, or usage frequency of one or more articles in a given time-period.

* * * * *